United States Patent [19]

Roche et al.

[11] Patent Number: 4,494,041

[45] Date of Patent: Jan. 15, 1985

[54] INCANDESCENT BALLAST ASSEMBLY

[75] Inventors: William J. Roche, Merrimac; John W. Anderson, Jr., Ipswich, both of Mass.

[73] Assignee: GTE Products Corporation, Stamford, Conn.

[21] Appl. No.: 463,226

[22] Filed: Feb. 2, 1983

[51] Int. Cl.[3] ..... H01J 7/44

[52] U.S. Cl. ..... 315/49; 315/101; 315/105; 315/179

[58] Field of Search ..... 315/49, 179, 101, 97, 315/92, 64, 65, 105

[56] References Cited

U.S. PATENT DOCUMENTS 4,268,780 5/1981 Roche et al. ..... 315/174
4,297,616 10/1981 Corona ..... 315/179
4,350,929 9/1982 Katoogi ..... 315/101
4,358,710 11/1982 Magai ..... 315/101

*Primary Examiner*—Harold Dixon
*Attorney, Agent, or Firm*—Thomas H. Buffton

[57] ABSTRACT

Apparatus for use with a fluorescent lamp having a longitudinal axis and a filament winding at each end includes a pair of terminals formed for connection to a potential source with means for connecting one of the terminals to a filament winding, an incandescent lamp coupling the other terminal to the filament winding at the other end of the fluorescent lamp, a starting aid extending along the longitudinal axis of the fluorescent lamp and an impedance coupling the starting aid to the junction of the incandescent lamp and a filament winding of the fluorescent lamp.

8 Claims, 3 Drawing Figures

INCANDESCENT BALLAST ASSEMBLY

TECHNICAL FIELD

This invention relates to ballast and starting apparatus suitable for use with fluorescent lamps and more particularly to a ballast assembly of the resistance type utilizing an incandescent lamp in conjunction with a lamp starting arrangement employing a starting aid contacting the fluorescent lamp.

BACKGROUND ART

In the lighting field, the high cost of energy has mandated replacement of the universally used incandescent lamp with the more energy efficient fluorescent lamp. Also, it is highly desirable to effect this lamp replacement without an undesired replacement of the fixtures already in use. Moreover, cost, efficiency, weight of the replacement, and ease of replacement of the lamps are all factors to be taken into consideration if an acceptable replacement product is to prove effective.

One known approach to the problem of replacing incandescent lamps with fluorescent lamps includes the employment of a choke-type ballast assembly. Therein, relatively rapid changes in current with time in a choke coil or the "L di/dt" chacteristic of a choke ballast is utilized to provide a pulse potential necessary to the starting of a fluroescent lamp. However, choke coils not only are costly but also undesirably add weight which may be deleterious to the fixture already in place.

Another known approach to the problem of replacing incandescent lamps with fluorescent lamps involves the employment of a resistive type ballast assembly. Therein, it is not uncommon to employ a glow starter, resistor and capacitor to provide the necessary starting and operation capabilities. However, undesired energy loss and heat generation by the resistive type assembly are characteristics deleterious to a capable replacement apparatus.

Still another arrangement for replacing incandescent lamps with fluorescent lamps includes a resistive-type ballast arrangement wherein an incandescent lamp is utilized as the resistive element. Thus, the energy previously wasted by the resistor may be utilized by the incandescent lamp to add to the output of the fluorescent lamp.

However, one of the problems associated with a resistive ballast arrangement employing an incandescent lamp as the resistive element is the improper utilization of the incandescent lamp. More specifically, the ordinary ballast arrangement includes a glow bottle shunted across the fluorescent lamp filaments and an incandescent lamp coupling one of the filaments to the voltage supply or source. The glow bottle includes the usual bimetal within a gas-containing envelope. Upon activation, the gas ionizes causing the bimetal to heat and deflect to provide a short-circuit so that current is applied to the filaments of the fluorescent lamp. Thereafter, the bimetal cools which opens the preheat circuit and the energy applied across the heated filaments is sufficient to cause ignition of the lamps.

Normally, each of the filaments of the fluorescent lamps will have a voltage drop thereacross of about ten-volts during the preheating phase which leaves a drop of about 80% of the 120-volt supply voltage across the incandescent lamp. However, during normal operation of the fluorescent lamp, the incandescent lamp will operate at about one-half or 50% of the supply voltage.

Thus, a resistive ballast employing an incandescent lamp presents a serious design problem. If the incandescent lamp is designed to operate at one-half or 50% of the supply voltage, the bulb would be overstressed during the preheat period since about 80% of the supply voltage would be applied to the incandescent lamp. Thus, a short life span would result. On the other hand, an incandescent lamp designed to operate at 80% of the service voltage would receive only about 50 to 60% of the service voltage during normal operation of the fluorescent lamp. Thus, the lumen output of the incandescent lamp would fall to about 30% of the rated value which is obviously unsatisfactory insofar as efficiency is concerned.

Another problem associated with resistive ballast configurations is the difficulty of starting the fluorescent lamp. As is known, one method of inducing a starting voltage is to provide voltage spikes. However, such techniques involve added choke coils or other forms of additional apparatus which undesirably add to the cost and complexity of the apparatus. Other techniques include the utilization of an electrically floating conductive stripe within or affixed to the outer surface of the fluorescent lamp envelope. However, the known structures require a relatively high supply voltage in order to effect the capability for starting a fluorescent lamp. Since the starting voltages are limited to the 120-volt supply voltages, increased high voltage is not an alternative..

OBJECTS AND SUMMARY OF THE INVENTION

An object of the present invention is to provide an enhanced ballast assembly for a fluorescent lamp. Another object of the invention is to improve the starting capability of a fluorescent lamp arrangement. Still another object of the invention is to provide an economical and energy efficient ballast assembly for a fluorescent lamp.

These and other objects, advantages, and capabilites are achieved in one aspect of the invention by an incandescent ballast assembly for a fluorescent lamp wherein the fluorescent lamp is shunted by a series connected starter and unidirectional conduction device and a pair of terminals formed for connection to a potential source having one terminal connected by an incandescent lamp to one filament winding, the other terminal connects to another filament winding, and a starting aid affixed to the lamp and connected by an impedance to a junction of the incandescent lamp and a filament winding.

In another aspect of the invention, potential available at a potential source is applied to the bulb of the fluorescent lamp by way of an impedance coupled to a starting aid affixed to the fluorescent lamp and tq the junction of an incandescent and a filament winding. Thus, the fluorescent lamp has a potential on the bulb thereof and an added applied potential of an amount sufficient to effect a field breakdown and lamp ignition.

BEST MODE FOR CARRYING OUT THE INVENTION

For a better understanding of the present invention, together with other and further objects, advantages and capabilites thereof, reference is made to the following disclosure and appended claims in conjunction with the accompanying drawings.

Figure 1:
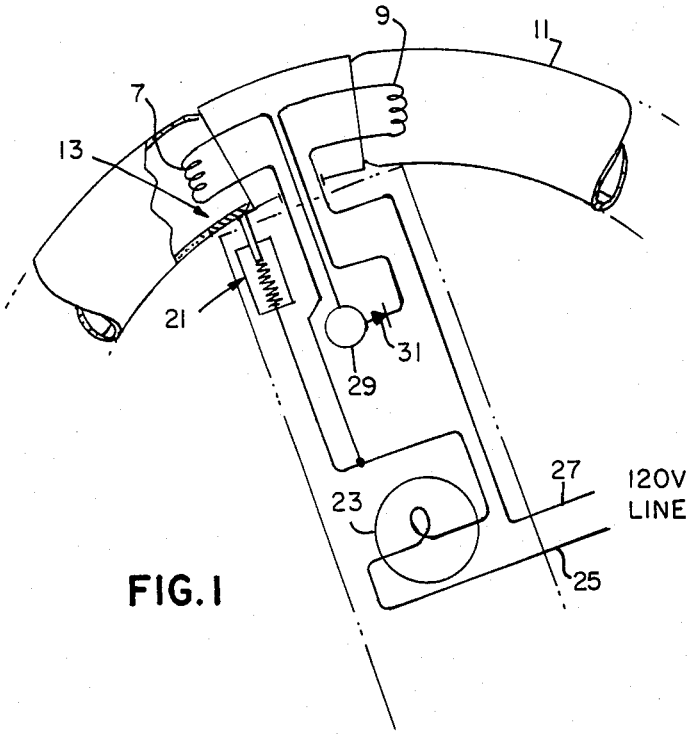
FIG. 1 is a diagrammatic illustration of a preferred form of fluorescent lamp and incandescent ballast assembly.

Referring to the drawings, FIG. 1 illustrates a fluorescent lamp and accompanying incandescent ballast assembly combination. A fluorescent lamp 5, preferably but not necessarily of a substantially circular configuration, has a filament winding 7 and 9 at each end of an envelope 11. The envelope 11 has a longitudinal axis extending thereby between the filament windings 7 and 9 respectively. A starting aid 13 which is preferably in the form of a metallized tape, extends along the longitudinal axis between the filament windings 7 and 9. The starting aid 13 is preferably affixed to the inner perimeter of the envelope 11 but may be attached to a fixture (not shown) extending in an essentially parallel realtionship to the envelope 11.

Figure 2:
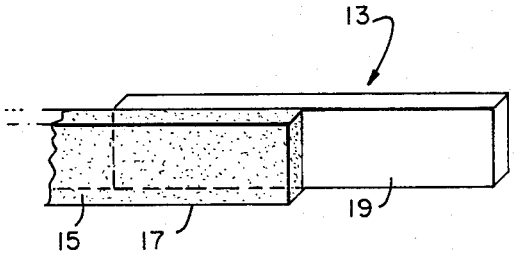
FIG. 2 is an enlarged view of a starting aid connecting arrangement.

As can be seen in the illustration of FIG. 2, the starting aid 13 is preferably in the form of a polyester tape 15 having metallized layer 17 thereon. A brass strip 19, such as a piece of brass shim stock for example, is affixed to the metallized layer 17 of the polyester tape 15 to provide a high impedance connection therebetween. This high impedance connection, about $10^6$ ohm for example, serves to eliminate any potential shock hazard in the event of personal contact therewith. Also, a spring loaded connector 21 of FIG. 1 couples the high impedance by way of the brass strip 19 to the junction of one filament winding 7 and an incandescent lamp 23. Moreover, the incandescent lamp 23 couples to the filament winding 7 and the spring-loaded connector 21 to one terminal 25 of a pair of terminals 25 and 27 formed for connection to a potential source (not shown).

The other terminal 27 of the pair of terminals 25 and 27 is directly connected to the other filament winding 9 of the fluorescent lamp 5. Also, a starter means 29 and a unidirectional conduction device 31, such as a diode, are series connected to the filament windings 7 and 9 of the fluorescent lamp 5. Preferably, the starter means 29 is a glow bottle type starter having a configuration which includes either a fixed terminal with a bimetal adjacent thereto or two parallel bimetal elements whereby a polarized or nonpolarized conductivity capability is provided. If a polarized starter is used, the anode of the diode must be connected to the bimetal contact of the starter. The diode 31 is available from numerous sources including the Motorola Company whereat it is designated as a 200-volt, IN 4003 diode. Also, the fluorescent lamp may be a well-known so-called 8-inch "Circline" lamp manufactured by General Telephone Company of Danvers, Mass., while the incandescent lamp is a 75-volt, 400 ma. lamp.

Figure 3:
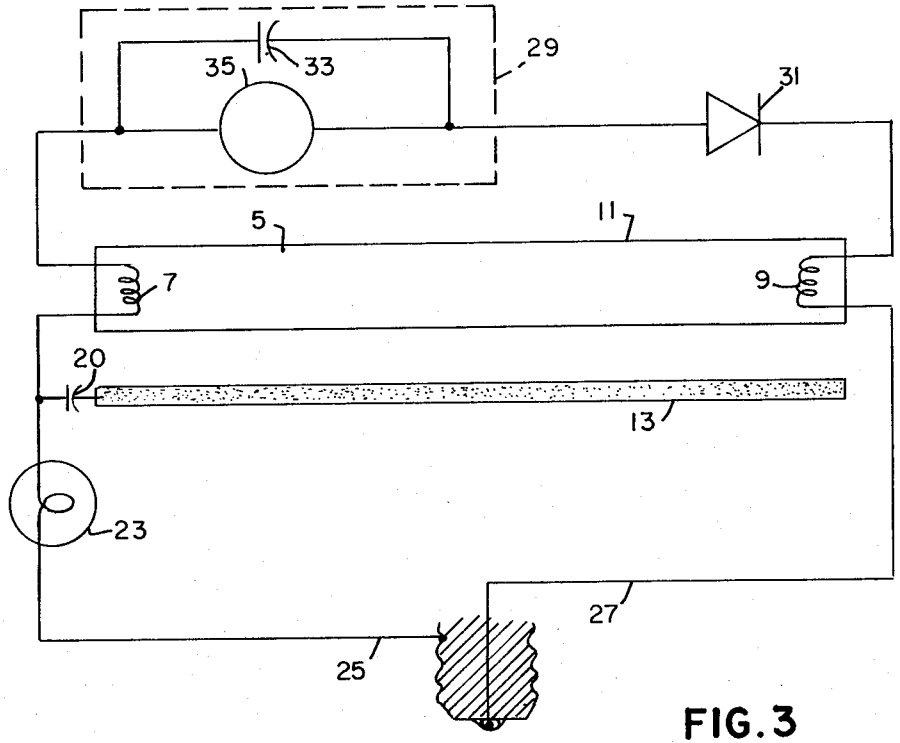
FIG. 3 is a circuit diagram illustrating the incandescent ballast and fluorescent lamp arrangement of FIG. 1.

Referring to the circuit diagram of FIG. 3, the fluorescent lamp 5 has a longitudinal axis extending between filament windings 7 and 9 at opposite ends of an envelope 11. A starting aid 13, such as metallized tape, is coupled by a high impedance connector 20 to one of the filament windings 7 and to an incandescent lamp 23. The incandescent lamp 23 is connected to a terminal 25 formed for connection to a potential source. Another terminal 27 is coupled to the other filament winding 9. Also, a glow starter means 29 in series connection with the diode 31 is coupled to the filament windings 7 and 9. Moreover, a capacitor 33 shunts a glow bottle 35 to provide the glow starter 29.

As to operation, it has previously been noted that an ordinary incandescent lamp ballast arrangement results in a voltage drop across the incandescent lamp during the filament winding preheat phase which is equal to about 80% of the supply voltage. Also, such a voltage drop is excessive insofar as optimum operational voltage of the incandesent lamp is concerned and deleterious to the life span of the lamp. However, the utilization of the unidirectional conduction device or diode 31 serves to reduce this preheat voltage appearing across the incandescent lamp 23 without encountering overheating problems since the diode 31 is essentially a lossless element.

Also, starting of the fluorescent lamp is effected by the starting aid coupled to the service voltage source by way of a high impedance. Ordinarily, a so-called "floating" starting aid which is merely affixed to the lamp envelope will raise the potential of the fluorescent lamp envelope to about one-half of the supply voltage. Such an envelope potential is sufficient when the supply voltage is sufficiently high. However, a relatively low supply voltage, as employed herein, necessitates transfer of the supply potential by way of the high impedance to the envelope of the fluorescent lamp in order to provide a field strength sufficient to effect lamp ignition.

More specifically, a control circuit employing a 120-volt source potential and no diode would provide a voltage drop of about 10 volts across each of the filaments and about 100 volts across the incandescent lamp during the preheat portion of the operational cycle. However, inclusion of the above-mentioned diode causes conversion of the 120-volt supply source to about 85 volts whereby about 65 volts appear across the incandescent lamp and about 10-volts across each filament winding during the preheat portion of the operational cycle. Upon attaining conduction of the fluorescent lamp, about 60 volts would appear across the incandescent lamp which will provide a desired lumen output suitable for addition to the output of the fluorescent lamp.

Thus, there has been provided an incandescent ballast assembly wherein means are provided for effecting efficient operation of an incandescent ballast lamp during and after preheating of a fluorescent lamp. Additionally, means are provided for effecting a starting capability for a fluorescent lamp utilizing a relatively low service voltage source.

While there has been shown and described what is at present considered the preferred embodiments of the invention, it will be obvious to those skilled in the art that various changes and modifications may be made therein without departing from the invention as defined by the appended claims.

We claim:

1. An incandescent ballast assembly for a fluorescent lamp having a filament winding at each end and a longitudinal axis extending between the filament windings, said ballast assembly comprising:

starter and unidirectional conduction device means connected in series with said filament windings at each end of said fluorescent lamp;

starting aid means extending along the longitudinal axis of and contacting said fluorescent lamp;

an incandescent lamp series connected to a filament at one end of said fluorescent lamp;

a pair of terminals formed for connection to a potential source and connected to said incandescent lamp and to said filament at the other end of said fluorescent lamp; and impedance means coupling said starting aid means to a junction of said incandescent lamp and to said filament at said one end of said fluorescent lamp.

2. The incandescent ballast assembly of claim 1 wherein said series connected starter is in the form of a gas-filled glow tube.

3. The incandescent ballast assembly of claim 1 wherein said starter means is in the form of a polarized gas-filled glow tube having a fixed post and a bimetal with said bimetal coupled to the anode of said diode means;

4. The incandescent ballast assembly of claim 1 wherein said starter means is in the form of a nonpolarized glow tube having two parallel bimetal contacts requiring no diode polarization.

5. The incandescent ballast assembly of claim 1 wherein said starting aid means is in the form of a metallized strip.

6. The incandescent ballast assembly of claim 1 wherein said starting aid means includes a resilient electrically conductive means connecting a metallized strip to said impedance means.

7. The incandescent ballast assembly of claim 1 wherein said impedance means is in the form of a capacitor.

8. The incandescent ballast assembly of claim 1 wherein said fluorescent lamp is in the form of a circular tube having a longitudinal axis extending intermediate said filaments at each end and said starting aid is positioned along the inner perimeter of said circular tube intermediate said filaments.

* * * * *